US005752571A

United States Patent [19]

Sapozhnikov

[11] Patent Number: 5,752,571

[45] Date of Patent: May 19, 1998

[54] APPARATUS FOR GENERATING IMPACTS

[76] Inventor: Zinoviy A. Sapozhnikov, 1310 Turk St. No. 206, San Francisco, Calif. 94115

[21] Appl. No.: 573,455

[22] Filed: Dec. 15, 1995

[51] Int. Cl.[6] ..... B25D 9/18

[52] U.S. Cl. ..... 173/206; 173/13; 173/204; 173/131; 173/212; 91/278; 91/300

[58] Field of Search ..... 173/13, 209, 212, 173/206, 207, 131, 121; 91/268, 272, 278, 300

[56] References Cited

U.S. PATENT DOCUMENTS

| | | | |
|---|---|---|---|
| 3,612,188 | 10/1971 | Ono . | |
| 4,563,938 | 1/1986 | Henriksson | 173/206 |
| 5,065,824 | 11/1991 | Ottestad | 173/206 |
| 5,088,565 | 2/1992 | Evarts . | |
| 5,107,934 | 4/1992 | Atchison . | |
| 5,117,924 | 6/1992 | Bermingham . | |
| 5,129,466 | 7/1992 | Bartels et al. | 173/13 |
| 5,520,254 | 5/1996 | Weber | 173/212 |

*Primary Examiner*—Scott A. Smith

*Attorney, Agent, or Firm*—Thomas I. Rozsa; Tony D. Chen

[57] ABSTRACT

An apparatus for generating impacts which has a hydraulic cylinder and a reciprocating piston. The hydraulic cylinder has an impact chamber, a cavity which receives and diverts fluid, and a throat which connects the impact chamber with the cavity. When the pressure line is connected to the cavity, the piston is lifted to an upper position. When the overflow line is connected to the cavity, the piston drops down such that the piston enters and covers the throat at the impact chamber. The pressure in the chamber remains low as the chamber is sealed by the piston entering the throat, where the energy loss is insignificant. The piston enters into the throat such that it is stopped and presses against the fluid inside the impact chamber, and thereby generates an impact therein. The piston is lifted up to repeat the cycle, when the cavity is connected to the pressure line. When the fluid inside the chamber is pressed by the piston, the impact is produced in the chamber and the volume of height reduction determines the volume of deceleration and the force of impact. The volume of height reduction is determined by the chamber working capacity. To increase the power of the impact, an inertia mass is attached to the piston.

18 Claims, 9 Drawing Sheets

APPARATUS FOR GENERATING IMPACTS

BACKGROUND OF THE INVENTION

A disclosure of this invention was filed with the Patent Office document disclosure branch on Jan. 5, 1995 and was assigned Document No. 368950.

1. Field of the Invention

The present invention relates to the field of pile drivers. More particularly, the present invention relates to the field of hydraulic pile drivers. In particular, the present invention may be used in striking and vibratory machines to provide different technologies, e.g., stamping, punching, compressing, destructing, and etc.

2. Description of the Prior Art

Various pile driving equipment has been produced by manufacturers such as Vulcan Iron Works Inc., Pileco Inc., and Continental Machine Company, Inc. It is known that these conventional pile drivers in general utilize a weight as a hammer, the weight being perpendicularly dropped on the head of a pile to effect the driving of the pile into the ground by percussion. The disadvantage with conventional pile drivers is that they are noisy because of the metal-to-metal impact. Also, the metal-to-metal impact can cause substantial damage to the hammer and the head of the pile. To reduce the damage caused the by metal-to-metal contact, the conventional pile driver utilizes a damping means, such as a resilient cover attached to the hammer or the head of the pile. Therefore, the damage caused by the metal-to-metal contact are partially reduced. To reduce the noise peaks of percussions, the hammers are lined with sound absorbing sheets. However, the noise remains deafening and the striking parts of the hammers can crack once in a while. The weight of the hammers is great. More then half of the kinetic energy of the falling ram or piston is wasted in the percussion and damping means.

Another type of prior art pile driver is the vibratory pile driver. The forces caused by the rotating eccentric pairs of weights will act upon the pile in the vertical direction. The downward movement presses the pile into the ground and the following upward movement will pull the pile upwardly. Thus by repeatedly pressing and pulling the pile by the upward and downward movements of the weight, the pile is gradually driven further into the ground. According to mechanics law, the dynamic force produced by rotating eccentric weight is determined by the power output. That is why the power output of regular vibratory pile drivers many times exceeds a reasonable volume. Most of the energy is spent to disturb the earth. The conventional hydraulic vibratory drivers are heavy powerful complicated machines, expensive in manufacturing and maintenance, and which are fed by special units with power output up to sixteen hundred (1600) horse power.

The following four (4) prior art patents were uncovered in the pertinent field of the present invention:

1. U.S. Pat. No. 3,612,188 issued to Ono on Oct. 12, 1971 for "Noiseless Pile Driver" (hereafter "the Ono Patent");

2. U.S. Pat. No. 5,107,934 issued to Atchison on Apr. 28, 1992 for "Pile Driver" (hereafter "the Atchison Patent");

3. U.S. Pat. No. 5,117,924 issued to Bermingham on Jun. 2, 1992 for "Energy Transfer Unit For A Pile Driver" (hereafter "the Bermingham Patent"); and 4. U.S. Pat. No. 5,088,565 issued to Evarts on Feb. 18, 1992 for "Vibratory Pile Driver" (hereafter "the Evarts Patent").

The Ono Patent discloses a noiseless pile driver apparatus. It comprises a main body which is suspended by a wire from the top of a tower erected at the point of the pile-driving operation for a pile. Two main parts of the apparatus are an impact-generating mechanism which enables a weight to reciprocate vertically, and impact-enforcing means located under the impact-generating mechanism which transmits the pile-driving force generated by the impact-generating mechanism more effectively by utilizing the resilience of a fluid such as air or oil as a cushion for preventing the impact from directly acting on the pile head.

The Evarts Patent discloses a vibratory pile driver. It comprises means for clamping onto a pile to be driven or extracted substantially vertically, a hydraulic gear motor having two opposite rotatable shafts and a pair of semicircular weights aligned in the same vertical plane. Each weight is rotatably secured to a shaft parallel to the motor shafts. Means, such as a drive and driven pulleys, sprockets or the like are connected by means such as toothed timing belts, chains or the like, respectively, and are provided for driving the weights from the motor shafts. The gears of the hydraulic gear motor operate in synchronization and the weights are driven synchronously to provide substantially linear forces.

The Atchison Patent discloses a pile driver. It comprises a holder for receiving one end of a pile, a first plate closing the top end of the holder, a hammer on the holder in contact with the first plate in the rest position, a first guide extending upwardly from the holder through the hammer for guiding the hammer during reciprocation thereof against the first plate, and two fluid actuated cylinders for elevating the hammer with respect to the holder. The holder is placed on the pile such that the hammer is elevated and released to fall into contact with the first plate for driving the pile downwardly.

The Bermingham Patent discloses an energy transfer unit for use in conjunction with a pile driving hammer.

Therefore, it is highly desirable to have a very efficient and also very effective design and construction of a pile driving apparatus for driving a pile into the ground without metal-to-metal contact, and thereby eliminate the metal-to-metal impact. It is desirable to provide a pile driving apparatus with the capability of only downward impacts, thereby minimizing the energy lost. It is also desirable to provide a resource saving pile driving apparatus with the capability of upward and downward impacts in a much more efficient way to maximum the energy used, thereby eliminating the waste of energy.

SUMMARY OF THE INVENTION

The present invention is a novel and unique apparatus for generating impacts. The apparatus comprises a hydraulic cylinder, a reciprocating piston located within the hydraulic cylinder, and a fluid feed and control means which connects the hydraulic cylinder to a power unit. The hydraulic cylinder comprises an impact chamber, a cavity which receives and diverts fluid, a throat which connects the impact chamber with the cavity, and an automatic regulator to decrease the outflow of the fluid through a circular slot that is formed when the piston enters the throat prior to impact.

To transfer impact onto the head of a driven pile, the piston is dropped, which piston accumulates enormous kinetic energy during dropping and accordingly, has a large inertia mass. When the pressure line is connected to the cavity, the piston is lifted to an upper position. When the overflow line is connected to the cavity, the piston drops down such that the piston covers the throat at the impact chamber. The piston approaches the throat such that a circular slot is formed between the piston and the throat. The circular slot becomes narrower as the fluid pressure in the impact chamber increases, thereby pushing a valve out of the impact chamber, whereby a spring stops contracting into the second position.

While the valve is moving up, the working fluid inside the impact chamber fills the vacated space occupied by the valve, thereby decreasing the outflow fluid through the slot. The pressure in the chamber remains low as the chamber is sealed by the piston entering the throat, where the energy is insignificant. The piston enters into the throat such that it is stopped from pressing against the fluid inside the impact chamber, and thereby impact occurs. The piston is lifted up to repeat the cycle, when the cavity is connected to the pressure line. When the pressure in the chamber and cavity levels out, the valve returns to its starting position with the aid of the spring.

When the fluid inside the chamber is pressed by the piston, the impact is produced in the chamber and the volume of height reduction determines the volume of deceleration and the force of impact. The volume of height reduction is determined by the chamber working capacity. To regulate the force of impact, the size of the washers inside the impact chamber must be changed. To increase the power of the impact, an inertia mass is attached to the piston.

In another embodiment of the present invention apparatus for generating impacts, the apparatus comprises a hydraulic cylinder, a reciprocating piston located within the hydraulic cylinder, a fluid feed and control means. The hydraulic cylinder comprises an impact chamber, a cavity which receives and diverts fluid, a throat which connects the impact chamber with the cavity, and an automatic regulator to decrease the outflow of the fluid through a circular slot that is formed when the piston enters the throat prior to impact. A carcass is attached to a driving cylinder. The driving cylinder has a reciprocating piston and a motionless plunger. The piston has a pressure cavity, where the plunger slides therein. A bore is provided within the plunger to feed the pressure cavity while the inertia mass is dropping, so that the plunger increases the dropping speed of the inertia mass, thereby reducing the energy waste.

In still another embodiment of the present invention apparatus for generating impacts, the apparatus comprises two hydro-cylinders which are located co-axially to each other with a common piston. Each hydro-cylinder has an impact chamber, a pressure cavity and a throat connecting the impact chamber to the pressure cavity.

Another embodiment of the present invention apparatus is an inversion of what can be used in a vibro hammer. The apparatus comprises two driving cylinders and two pairs of hydro-cylinders. Each hydro-cylinder has an impact chamber. All of the hydro-cylinders are located in pairs on a common piston.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
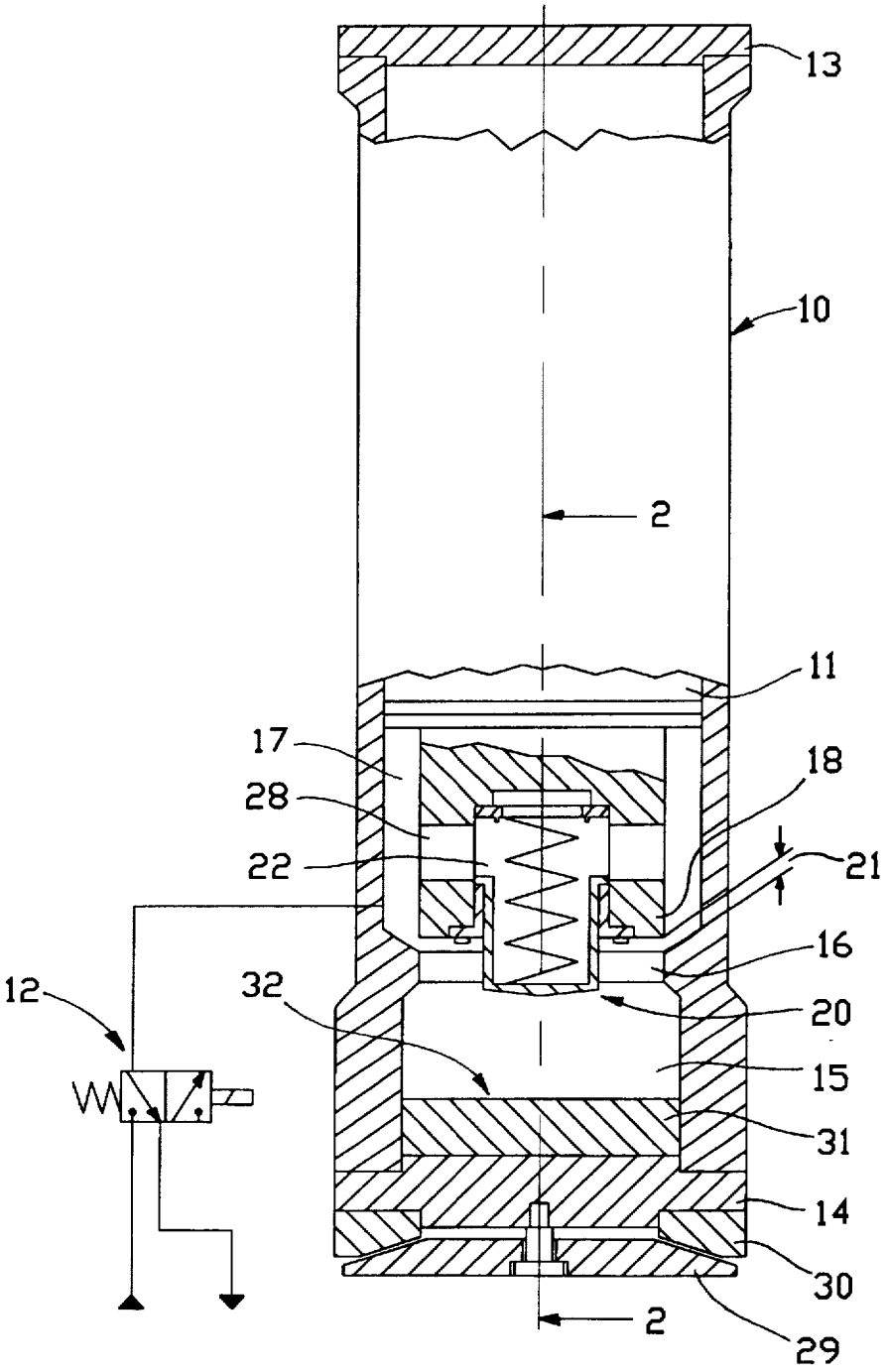
FIG. 1 is a partial cross-sectional view of the preferred embodiment of the present invention, showing a pile driving apparatus for generating impacts.
Figure 2:
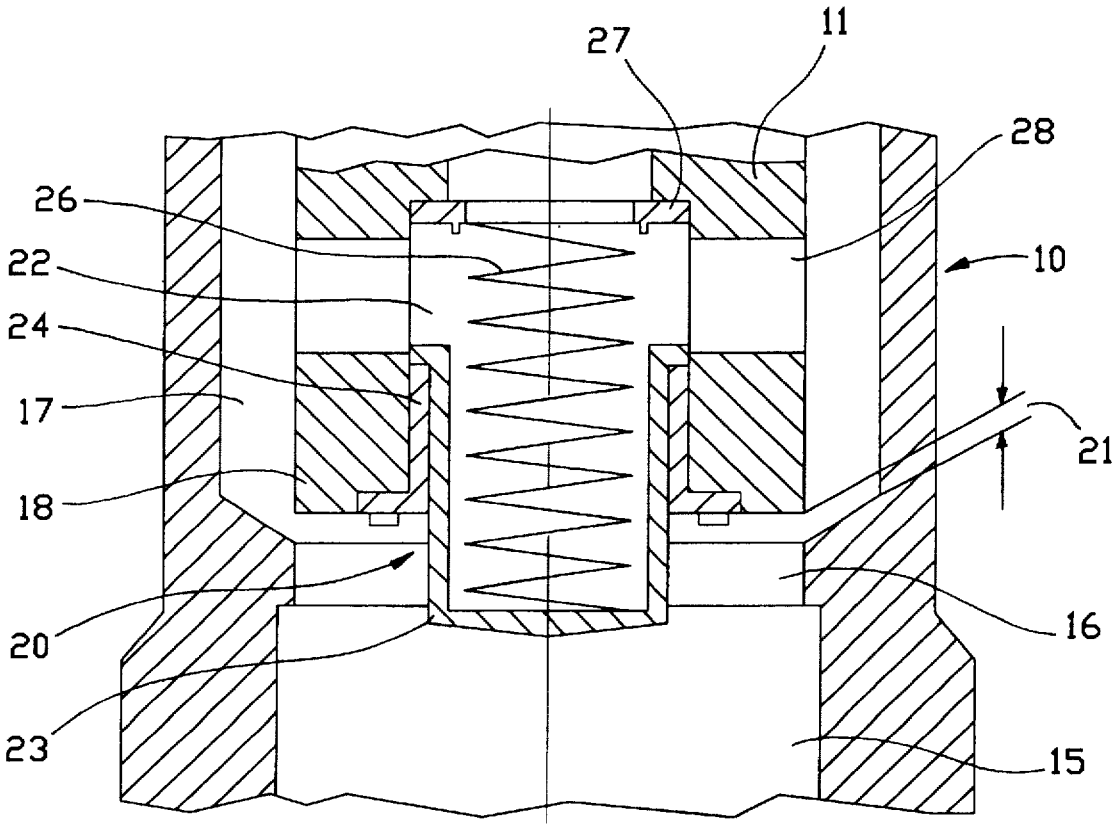
FIG. 2 is a partial cross-sectional view taken along line 2—2 of FIG. 1.
Figure 8:
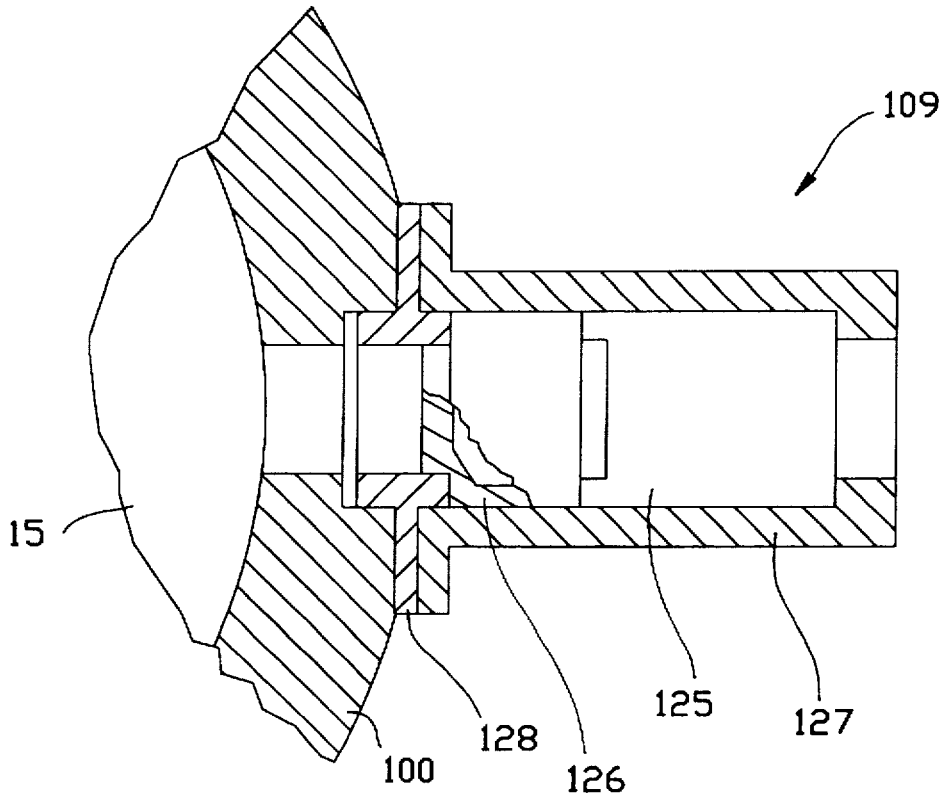
FIG. 8 is a partial cross-sectional view taken along line 8—8 of FIG. 6.

Referring to FIGS. 1 and 2, there is shown a first embodiment of the present invention; a pile driving apparatus for generating impacts. The apparatus comprises a hydraulic cylinder 10, a reciprocating piston 11 located within the hydraulic cylinder 10, and a fluid feed and control means 12 (partially shown in FIG. 1) which connects the hydraulic cylinder 10 to a power unit. The hydraulic cylinder 10 comprises a lid 13, a detachable bottom 14, an impact chamber 15, a cavity 17 which receives and diverts fluid, and a throat 16 which connects the impact chamber 15 with the cavity 17. The piston 11 has one end 18 that has the same diameter as the throat 16 for the piston to enter the throat 16 with minimum side play by friction condition. The hydraulic cylinder 10 has an automatic regulator 20 to decrease the outflow of the fluid through a circular slot 21 that is formed when the piston end 18 enters the throat 16 prior to impact. The regulator 20 is situated in a port 22 and has a two position valve 23 that moves within a bush 24 and located adjacent to the piston end 18. The valve 23 in its starting position is biased by a spring 26 between the end of the bush 24 and a thrust washer 27. The thrust washer 27 also serves as a valve stop for the valve 23, when the valve 23 moves into a second position before impact. The port 22 communicates with the cavity 17 by holes 28 (see FIG. 2). Another variation of the automatic regulator is shown in FIG. 8.

Figure 3:
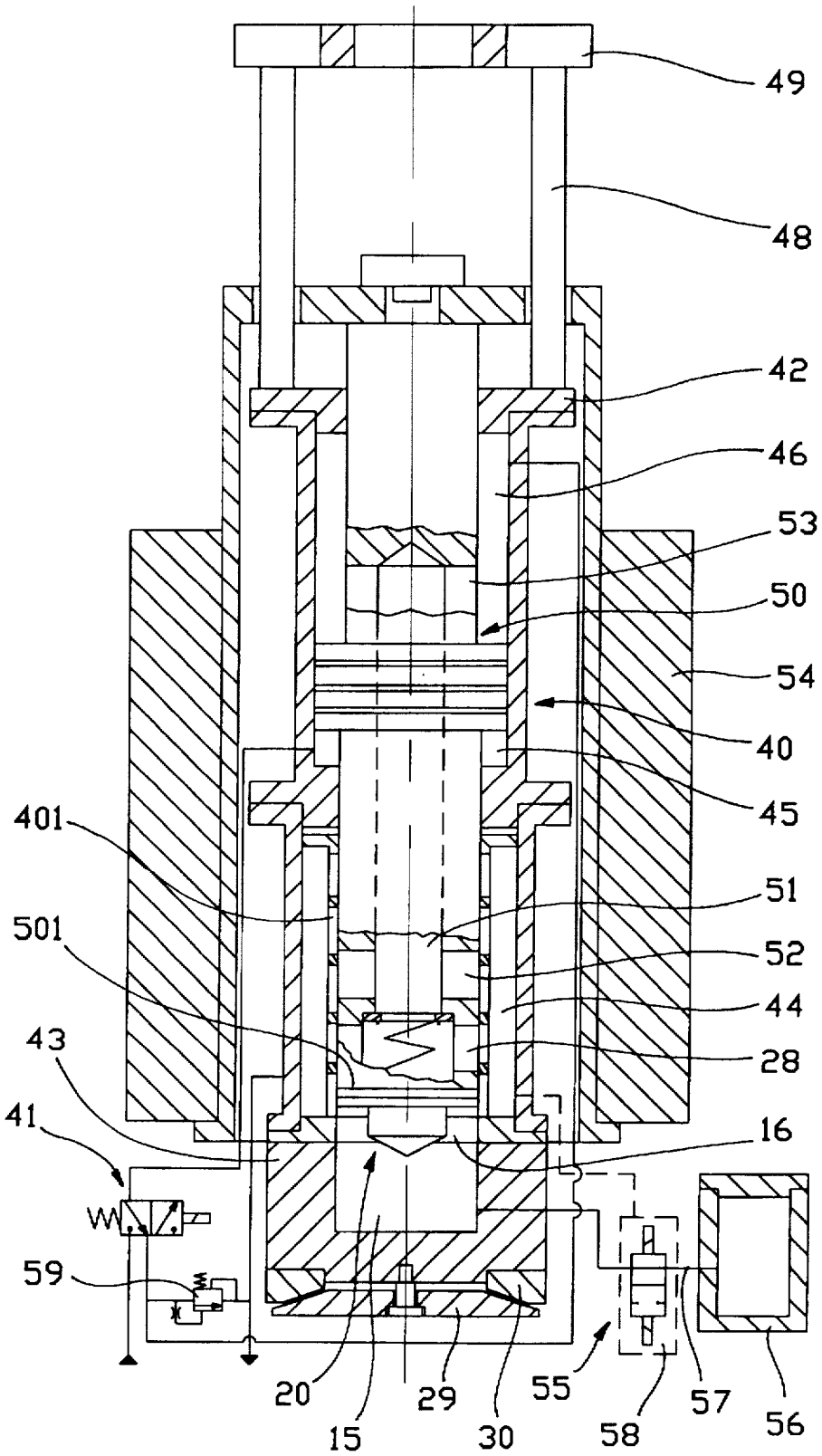
FIG. 3 is a partial cross-sectional view of an alternative embodiment of the present invention, showing another apparatus for generating impacts.

To transfer impact onto the head of a driven pile, the apparatus has a spheric washer 29 that abuts against an upper washer 30 attached to the detachable bottom 14. One of the changeable washer sets is 31 and is attached to the bottom 14 of the hydraulic cylinder 10 and located adjacent to the impact chamber 15. The detachable bottom 14, the changeable washer set 31 and fastening components are the simplest means for changing a chamber working capacity. These components are part of a device 32 to regulate the impact force. The chamber working capacity is the volume of the working fluid in the chamber during impact. When the piston 11 is dropped, it accumulates enormous kinetic energy and accordingly has a large inertia mass. Another variation of the device 32 to regulate the impact force is shown in FIG. 3.

While using the apparatus in the pile driving hammer, a spring suspension (not shown) is attached to the lid 13 and a pile clamp (not shown) is attached to the bottom 14. The pile clamped by the hammer is positioned by a crane such that the lower end of the pile is fixed to the ground. When the pressure line is connected to the cavity 17, the piston 11 is lifted to an upper position. When the overflow line is connected to the cavity 17, the piston 11 drops down such that the piston end 18 covers the throat 16 at the impact chamber 15. The piston end 18 approaches the throat 16 such that the circular slot 21 is formed between the piston end 18 and the throat 16. The circular slot 21 becomes narrower as the fluid pressure in the impact chamber 15 increases, thereby pushing the valve 23 out of the impact chamber 15, where the spring 26 stops contracting into the second position against the thrust washer 27.

While the valve 23 is moving up, the working fluid inside the impact chamber 15 fills the vacated space occupied by the valve 23 inside the impact chamber 15, thereby decreasing the outflow fluid through the slot 21. The pressure in the chamber 15 remains low as the chamber is sealed by the piston 11 entering the throat 16, where the energy lost is insignificant. The piston end 18 further enters the impact chamber 15 through the throat 16, where the valve 23 is moved up, in which the fluid inside the impact chamber 15 moves to the vacated space occupied by the valve 23 within the bush 24 so that the piston 11 stops and presses against the fluid inside the impact chamber 15, and thereby generates an impact therein. The piston 11 is lifted up to repeat the cycle, when the cavity 17 is connected to the pressure line. When the pressure in the chamber 15 and cavity 17 levels out, the valve 23 returns to its starting position with the aid of the spring 26.

When the fluid inside the chamber 15 is pressed by the piston 11, the impact is produced in the chamber and the volume of height reduction determines the volume of deceleration and the force of impact. The volume of height reduction is determined by the chamber working capacity. To regulate the force of impact, the size of the washers 31 inside the impact chamber must be changed.

Referring to FIG. 3, there is shown a second embodiment of the present invention; a pile driving apparatus for generating impacts. The apparatus comprises a cylinder 40, a reciprocating piston 50 located within the cylinder 40, and a fluid feed and control means 41 which connects the cylinder 40 with a power unit. The cylinder 40 has a lower body 43 and a lid 42 that covers the cylinder 40. The lower body 43 has an impact chamber 15 which communicates with a special cavity 44 by a throat 16. The special cavity 44 receives and diverts outflowing fluid. A pressure cavity 45 and a reservoir cavity 46 are provided within the cylinder 40 and both are located above the special cavity 44, where the special cavity 44 communicates with the cavity 46 by a duct 51 and holes 52 and 53 that are provided in the piston 50. The piston 50 has a piston ring 501 and a lattice bush 401, which are provided with the throat 16. Piston areas in the cavities 44 and 46 are approximately equal to provide for constant total volume of the fluid in the two cavities 44 and 46 while the piston 50 is reciprocating. To compensate for leaks and to cool the working fluid, circulation of the outflow fluid through the two cavities 44 and 46 is provided by connecting the cavities 44 and 46 with the outflow line before and after throttle 59. The pressure cavity 45 may be filled with oil, compressed air or steam. If the pressure cavity 45 is not filled with oil, the circulation can be provided by a special low pressure pump. To increase the power of the impact, an inertia mass 54 is attached to the piston 50.

A plate 49 is fastened to the lid 42 by studs 48 or other suitable means and suspended by a crane while using the apparatus in a pile driving hammer. The apparatus has a device 55 for regulating the impact force. The device comprises means to change an impact chamber working capacity, a container 56 which is a separate piece from the impact chamber 15, a pipeline 57 which connects the container 56 with the impact chamber 15, and a cut-off valve 58. While using the apparatus in the pile driving hammer, the spring suspension is attached to the plate 49 and the apparatus functions like the previous embodiment described above.

Figure 4:
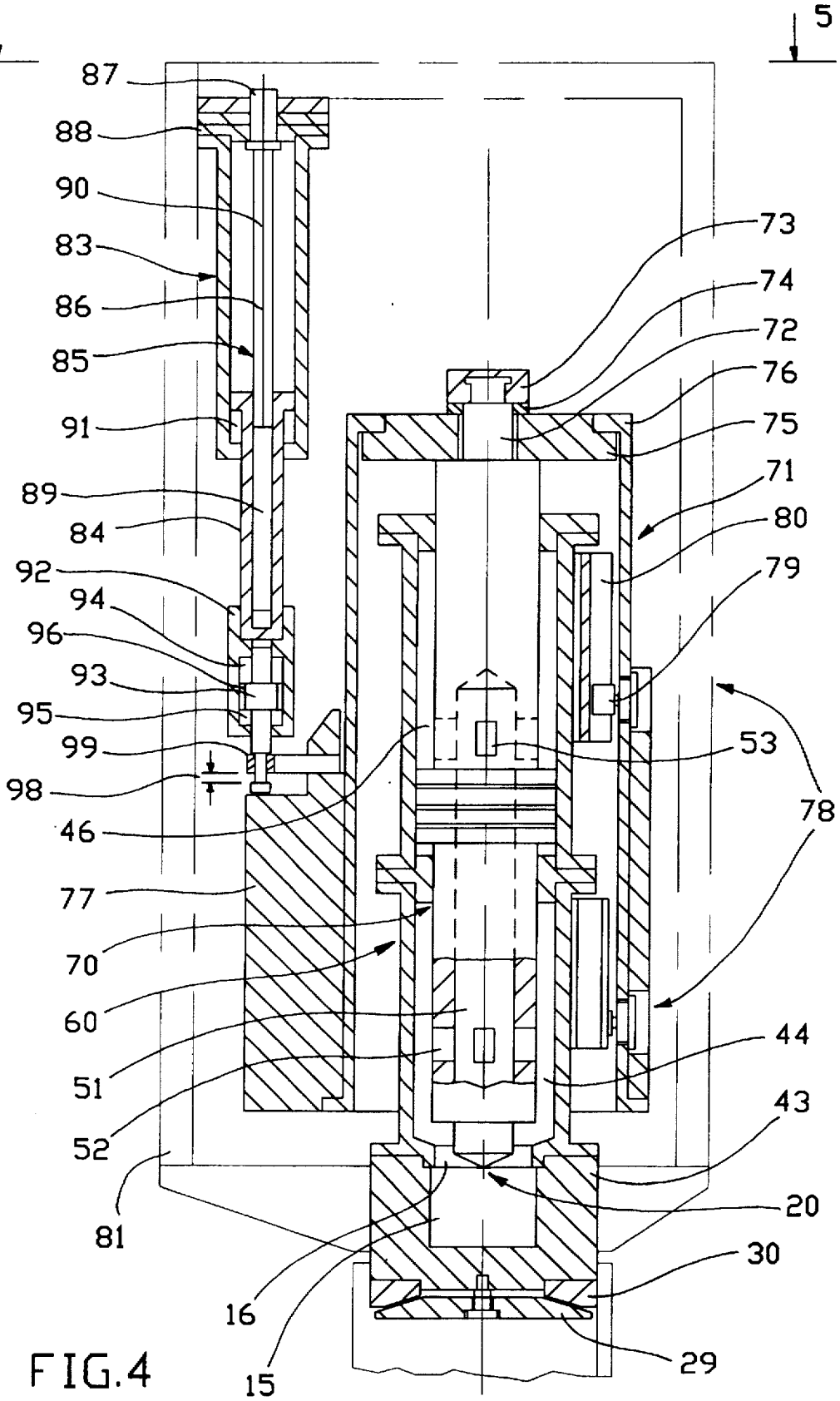
FIG. 4 is a partial cross-sectional view taken along line 4—4 of FIG. 5, showing another embodiment of the present invention apparatus for generating impacts.
Figure 5:
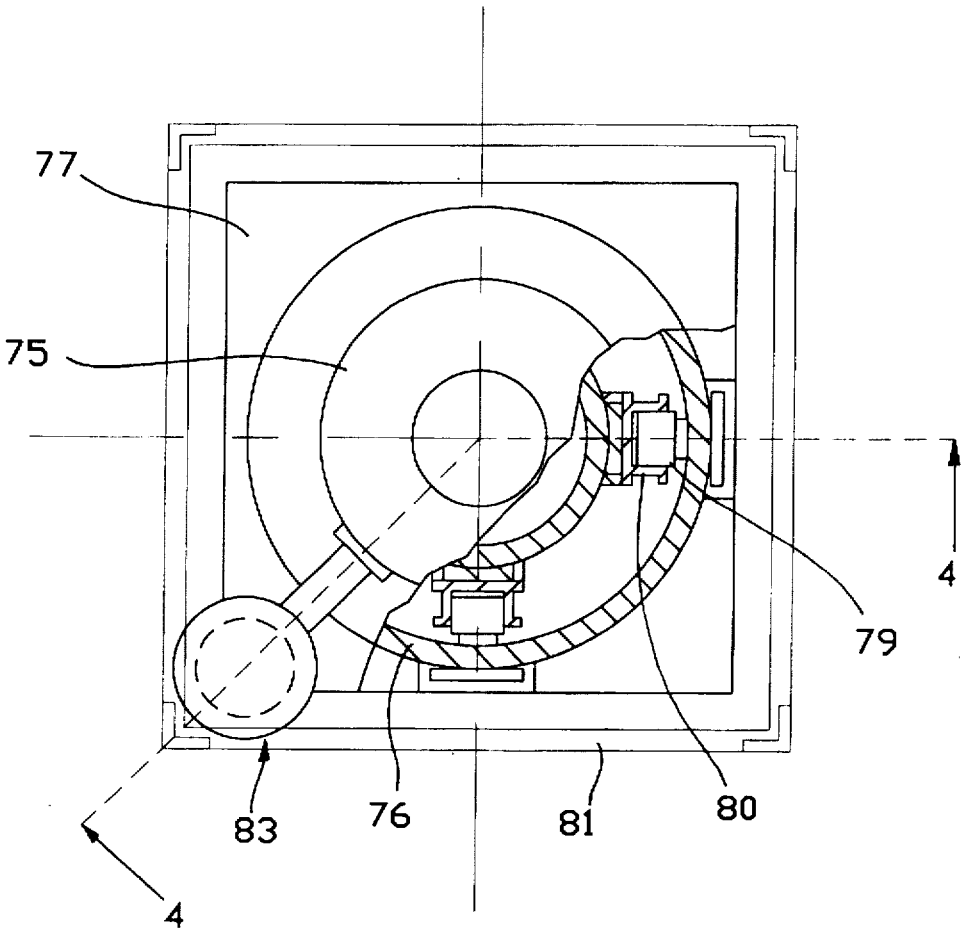
FIG. 5 is a partial top cross-sectional view taken along line 5—5 of FIG. 4.

Referring to FIGS. 4 and 5, there is shown a third embodiment of the present invention apparatus which comprises a cylinder 60 and an impact chamber 15 located within the cylinder 60. The impact chamber 15 communicates with a cavity 44 by a throat 16. The cavity 44 communicates with a cavity 46 by a duct 51 and holes 52 and 53 that are provided in a piston 70. An inertia mass 71 is placed loosely at a journal 72 and secured therein by means of a washer 74 and nut 73. The inertia mass 71 has the possibility of small cross movement. The inertia mass 71 is invertedly assembled with bottom 75 pointing upwardly. The inertia mass 71 has a cylinder wall 76 which is surrounded by a weight 77. The inertia mass 71 is connected with the cylinder 60 by means of spline roller joints 78. Each spline roller joint 78 comprises a roller 79 and a spline 80. The rollers 79 are fastened to the cylinder wall 76. The splines 80 are fastened to the cylinder 60 such that the rollers 79 move within the splines 80 with a small side play.

A carcass 81 is attached to a lower body 43 of the cylinder 60. The driving cylinder 83 is supported by the carcass 81. The cylinder 83 has a reciprocating piston 84 and a developer 85 for working fluid output. The developer 85 is defined by a motionless plunger 86 which is fixed at its end 87 to the bottom 88 of the cylinder 83. The piston 84 has a pressure cavity 89, where the plunger 86 slides therein. A bore 90 is provided within the plunger 86 to feed the pressure cavity 89 while the inertia mass 71 is dropping, so that the developer 85 increases the dropping speed of the inertia mass 71, thereby reducing the energy waste. The cylinder 83 is provided with a cavity 91 to lift the inertia mass 71 with the piston 70. The fluid feed and control means are conventional in respect with double-acting cylinders. The cavities 46 and 44 are connected to the outflow line as described above.

The piston 84 is attached to a hydraulic damper which is comprised of a cylinder 92 and a piston 93. The cylinder 92 has two cavities 94 and 95 which are connected by axial grooves 96 provided on the surface of piston 93. The piston 93 is joined with the end play to a holder 99 which is bolted to the cylinder wall 76, to allow the piston 93 to start upward before the impact has occurred. While using the apparatus in a pile driving hammer, a spring suspension is attached to the carcass 81 and a pile clamp is attached to the body 43 of the cylinder 60.

When the pressure line and the outflow line are connected with the cavity 91 and the bore 90 respectively, the piston 84 moves upward, thereby pulling the cylinder 92. The piston 93 rests on the holder 99 so that fluid flows through from the cavity 94 to the cavity 95 and the inertia mass 71 and the piston 70 move upward, thereby increasing the speed slowly. When the cavity 91 and the bore 90 connect to the outflow line and the pressure line respectively, the inertia mass 71 and the piston 70 drop down, and thereby the cylinder 92 is pressed by the piston 84 moving downward with the piston 96. The piston 96 rests on the holder 99, thereby increasing the dropping speed of the inertia mass 71 so that the fluid flows through from the cavity 95 to the cavity 94. The inertia mass 71 is held straight by the rollers 79 which move within the splines 80. In the same way the spline roller joints 78 rest on the weight of the mass 71 whenever an inclined pile driving is to be done.

Figure 6:
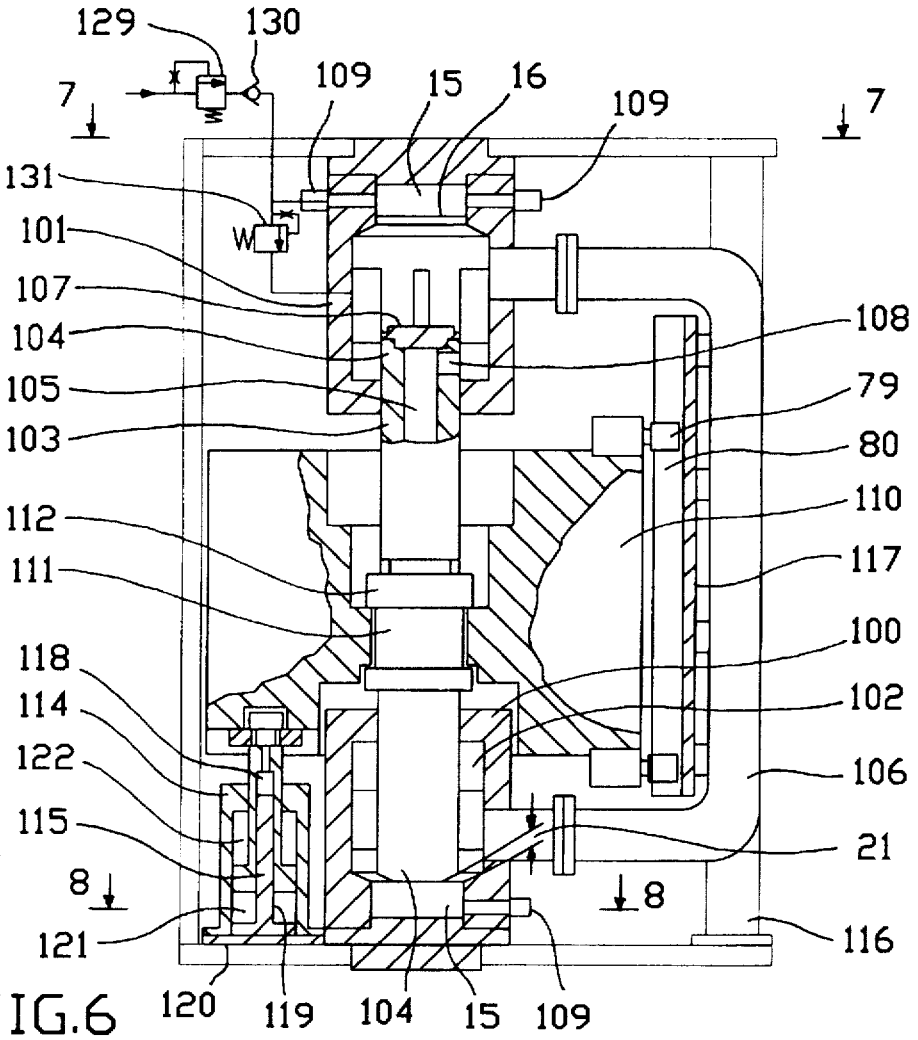
FIG. 6 is a partial cross-sectional view taken along line 6—6 of FIG. 7, showing still another embodiment of the present invention apparatus for generating impacts.
Figure 7:
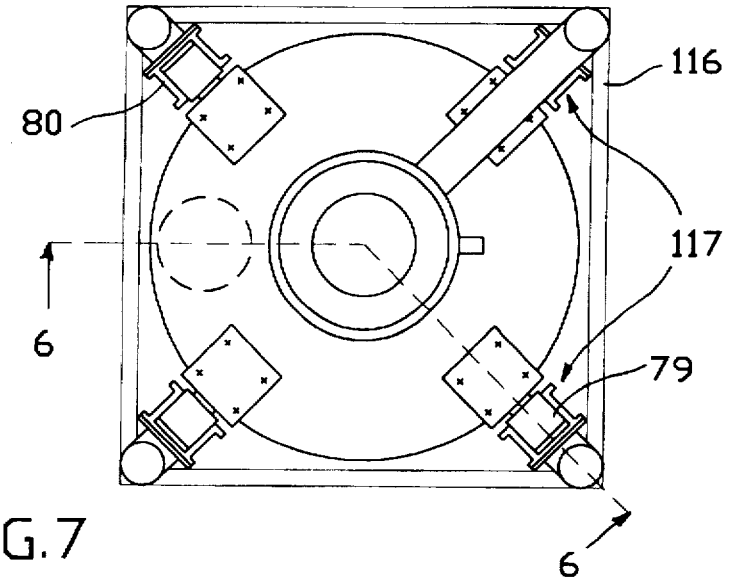
FIG. 7 is a top plan view taken along line 7—7 of FIG. 6.

Referring to FIGS. 6, 7 and 8, there is shown a fourth embodiment of the present invention apparatus for generating impacts. The apparatus comprises two hydro-cylinders 100 and 101 which are located co-axially with a common piston 103 therebetween. Each hydro-cylinder has an impact chamber 15 with a throat 16. The piston 103 has two opposite ends 104 which have the same diameter as the throat 16 of each impact chamber 15. Each hydro-cylinder is provided with a cavity 102. The cavities 102 are interconnected to each other by a duct 105 and outflow pipes 106 so that each hydro-cylinder serves as a reservoir for each other. The duct 105 communicates with the cavities 102 by holes 108 and can be plugged at each end by plugs 107. Each hydro-cylinder has an automatic regulator 109 for controlling and decreasing the outflow of the fluid. The apparatus is provided with an inertia mass 110 which is placed loosely on the journal 111 and secured by a nut 112. inertia mass 110 and the piston 103 are reciprocated by a driving hydro-cylinder 114. The driving hydro-cylinder 114 is fastened to the carcass 116 as shown in FIG. 6 with the outflow pipes 106 as part of the whole structure of the carcass 116. The carcass 116 is connected with the inertia mass 110 by means of spline roller joints 117. Each spline roller joint 117 comprises a roller 79 and a spline 80, where each roller 79 moves within each spline 80 to provide synchronization of all pistons and work of the apparatus at an inclined position.

The driving cylinder 114 is supported by the carcass 116. The driving cylinder 114 has a reciprocating piston 118 and the developer 115 for working fluid output. The developer 115 is defined by a motionless plunger 119 which is fixed to bottom 120 of the driving cylinder 114. The driving cylinder 114 has two cavities 121 and 122. The developer 115 reduces cross section area of the cavity 121 of the driving hydro-cylinder 114. Each regulator 109 reduces outflow of the working fluid through the circular slot 21 that is formed when the piston end 104 enters and seals the throat 16.

Referring to FIG. 8, there is shown the regulator 109 which is connected to the port of the impact chamber 15 through an adapter 128. A valve 126 is reciprocating in a bore 125 inside a body 127. At the starting position, the valve 126 is pressed against the inside surface of the adaptor 128 by means of the pressure of the fluid delivered from a hydropower unit through a flow control valve 129 and a non-return valve (one way valve) 130 (see FIG. 6). The regulator 109 is connected with the cavity 102 through another flow control valve 131. The cavities 102 are connected to the overflow line before and after a throttle 59 as shown in FIG. 3 for cavities 44 and 46. The driving hydro-cylinder 114 is connected to the pressure power unit in a conventional line pressure control to provide a two way control, one for downward impacts and the other for upward impacts. While providing downward impacts, the piston 103 during its upward motion stops in front of the top throat 16. While providing upward impacts, the piston 103 during its downward motion stops in front of the lower throat 16. While using the apparatus in a pile driving vibro hammer, just before impact occurs the cavity 121 is connected with the pressure line so that as soon as the impact occurs the piston 118 lifts the inertia mass 110 with the piston 103. The cavity 122 is connected to the pressure line of the piston 103 with the inertia mass 110 reduce the speed and change the direction of motion on opposite just in front of the top throat 16. All of the mutual interaction parts of the fourth embodiment of the present invention apparatus remain the same as described in FIGS. 4 and 5, and the description thereof will not be repeated. The apparatus could be used in the hammer. In this case hydro-cylinder 101 must be without impact chamber and the cavity 102 of the cylinder 101 will turn into a reservoir to provide for constant total volume of the fluid in the two cavities 102 while the piston 103 is reciprocating.

Figure 9:
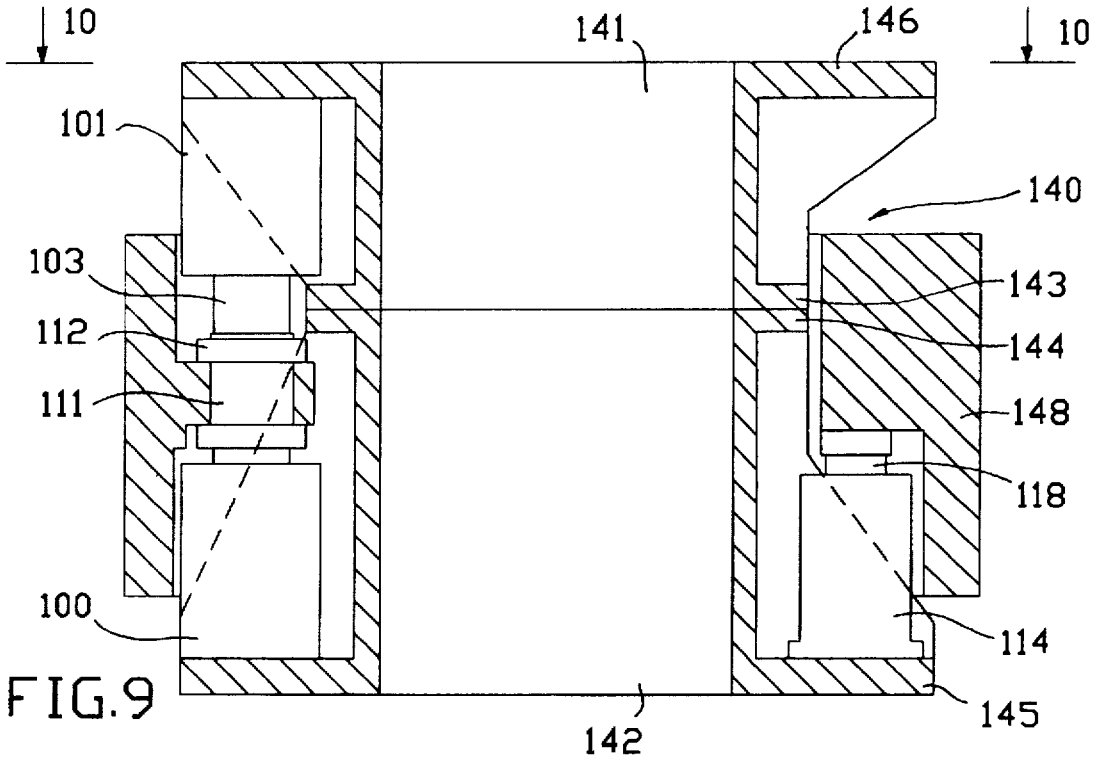
FIG. 9 is a cross-sectional view taken along line 9—9 of FIG. 10, showing still further another embodiment of the present invention apparatus for generating impacts.
Figure 10:
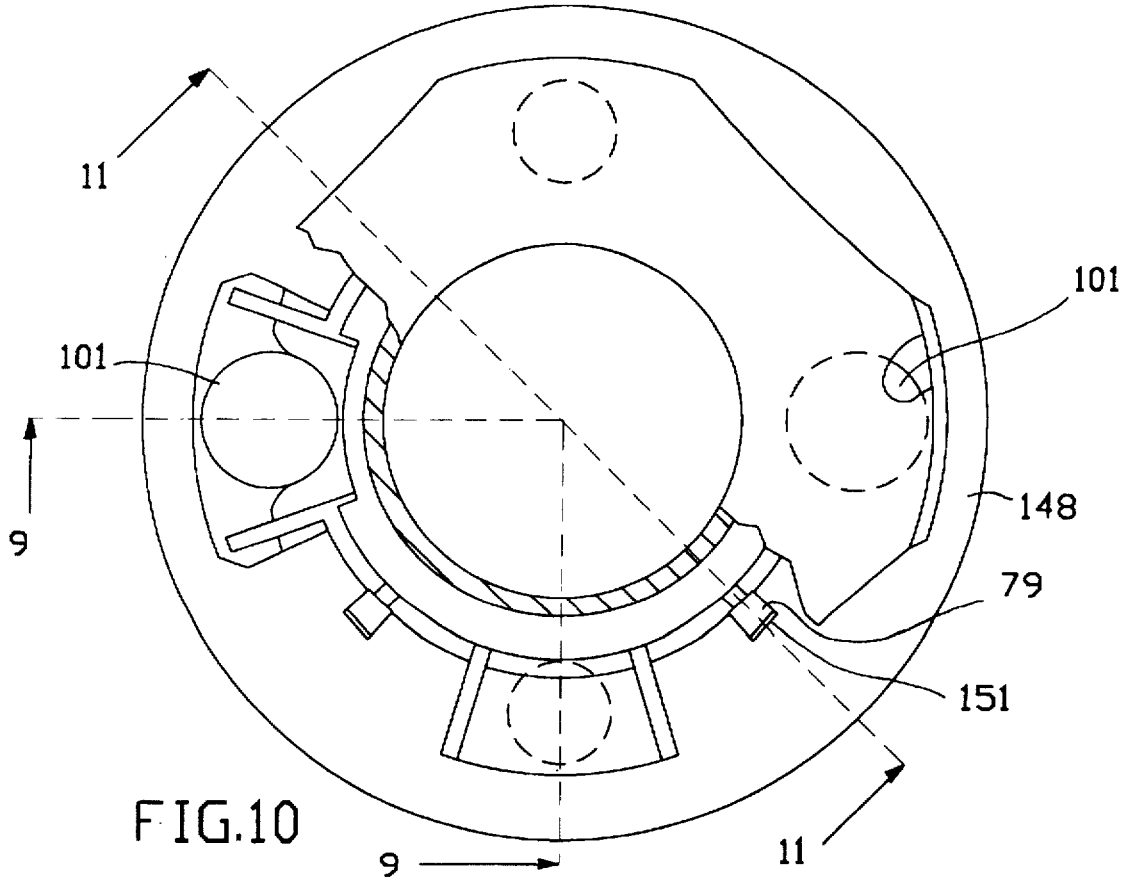
FIG. 10 is a partial top cross-sectional view taken along line 10—10 of FIG. 9.
Figure 11:
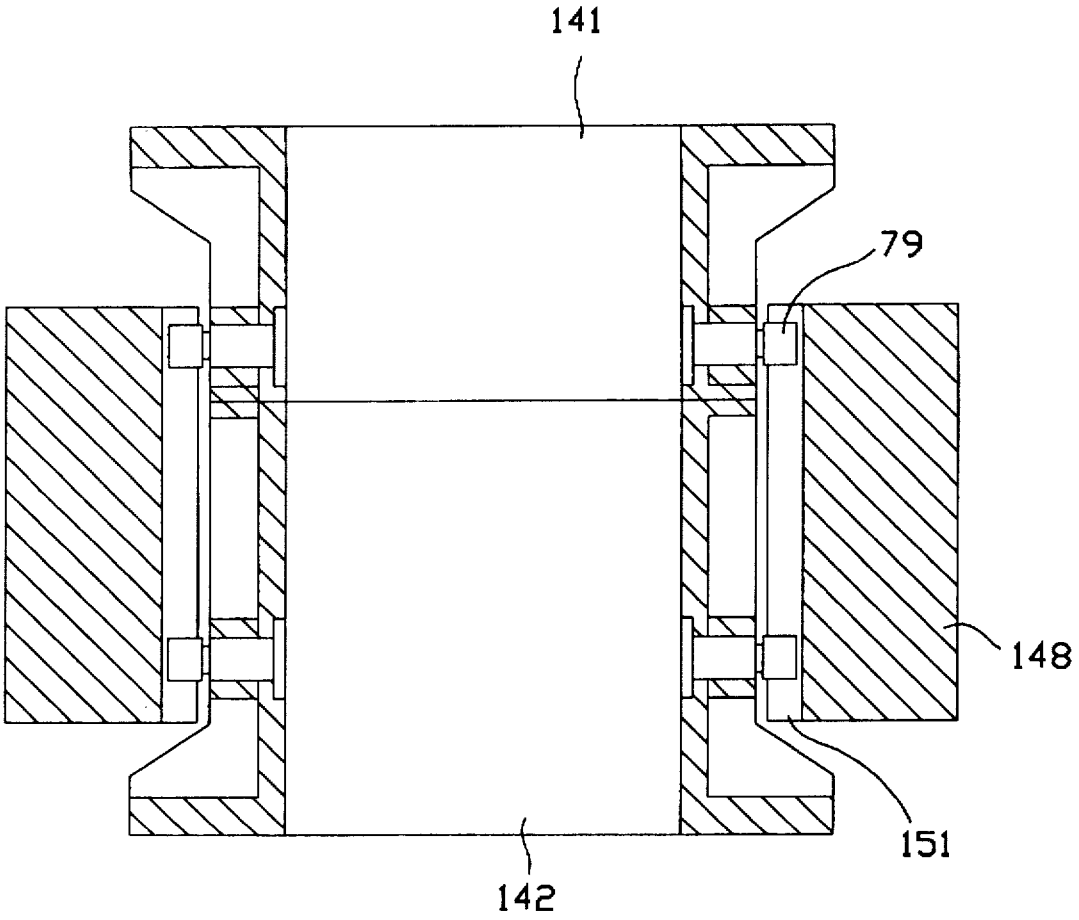
FIG. 11 is a cross-sectional view taken along line 11—11 of FIG. 10.

Referring to FIGS. 9, 10 and 11, there is shown a fifth embodiment of the present invention apparatus which is an inversion of what can be used in a vibro hammer. The apparatus comprises two driving cylinders 114 and two pairs of hydro-cylinders 100 and 101. Each hydro-cylinder has an impact chamber. All of the hydro-cylinders 100 and 101 are located in pairs on a common piston 103. The hydro-cylinders 100 and 101 are fixed on spool body 140 which consists of a top piece 141 and a bottom piece 142. The top and bottom pieces 141 and 142 are connected through flanges 143 and 144 respectively. On a lower flange of the spool 140, there are located hydro-cylinders 100 and 114. The hydro-cylinders 101 are fixed to a top flange 146. Pistons 103 and 118 are fastened to an inertia mass 148. To locate the hydro-cylinders and pistons, the windows and openings are provided in the inertia mass 148. The apparatus is provided with the inertial mass 148 which is placed loosely on a journal 111 and secured by a nut 112. The inertia mass 148 is connected to the hydro-cylinder by four spline roller joints. Each spline roller joint comprises two rollers 79 and a spline 151. Each spline roller joint is cross located to one another. The four splines 151 are attached to inertial mass and the eight rollers are fastened to the body 140. To obtain one impact from the two cylinders, the bottom impact chambers are connected by tubing (not shown). The top chambers of the cylinders 101 are connected the same way (not shown). Cross spline roller joints provide straight axial movement of the inertia mass and correspondingly synchronization of the cylinders and provide the possibility to work on an inclined position. The apparatus can be used in a vibro hammer application for sinking and withdrawing long piles when it is needed to clamp the pile along the length. In this case pile is in the hole of the spool 140. The apparatus is supplied with conventional suspension and clamps attached to the top and bottom flanges of the spool.

Defined in detail, the present invention is an apparatus for generating impacts, comprising: (a) at least two cylinders located coaxially to each other, each cylinder having a reciprocating piston, an impact chamber relative to the reciprocating piston, a damping means, a cavity relative to the impact chamber for receiving and diverting the damping means and a throat for connecting the impact chamber to the cavity; (b) the reciprocating pistons of the at least two cylinders connected with each other to form a common piston, where the common piston reciprocates within the at least two cylinders; (c) the common piston reciprocating within the at least two cylinders and having two opposite ends, a respective one of the two opposite ends approaching and entering a respective one of the throats and thereby closes a respective one of the impact chambers such that a respective one of the cavities receives and diverts the damping means to the respective one of the impact chambers and the cavities and connected by a duct located within the common piston, the common piston stops and presses against the damping means inside the respective one of the impact chambers, and thereby generates an impact therein; (d) the at least two cylinders, each further including an automatic regulator for regulating the damping means outflow through a circular slot to the respective one of the cavities to allow the respective of the two opposite ends of the common piston to move through the respective one of the throats and close the respective one of the impact chambers from the respective one of the cavities; (e) an inertia mass for increasing the power of the impact and fastened with the common piston and connected with the at least two cylinders by spline roller joints; (f) at least one driving cylinder driving and moving the inertia mass and the common piston; and (g) means for fastening the at least one driving cylinder to a body of the at least two cylinders.

Defined broadly, the present invention is an apparatus for generating impacts, comprising: (a) at least two cylinders located coaxially to each other, one of the at least two cylinders including, an impact chamber, damping means, a cavity for receiving and diverting the damping means, and a throat for connecting the impact chamber with the cavity, and the other one of the at least two cylinders including a reservoir cavity connected with the cavity relative to the impact chamber; (b) a common piston located and reciprocating within the at least two cylinders so that when the common piston enters the throat, thereby forming a slot between the common piston and the throat and closing the impact chamber from the cavity, the common piston stops and presses against the damping means inside the impact chamber, and thereby generates an impact therein, where the common piston is reciprocating the damping means such that it flows from the cavity to the reservoir cavity and the total volume of the damping means inside the at least two cylinders remain constant; and (c) an automatic regulator for regulating the damping means outflow through the slot prior to the impact; (d) whereby the pressure in the impact chamber remains low as the impact chamber is sealed by the common piston which enters the throat, and thereby the energy lost is insignificant.

Defined more broadly, the present invention is an apparatus for generating impacts comprising: (a) a hydraulic cylinder including a reciprocating piston therein, an impact chamber, damping means, a cavity for receiving and diverting the damping means, and a throat for connecting the impact chamber with the cavity; (b) the reciprocating piston having one end with the same diameter as the throat, the piston moves into an upper position so that when the piston drops down and enters the throat, thereby forming a slot between the piston end and the throat and closing the impact chamber from the cavity, the piston stops and presses against the damping means inside the impact chamber, and thereby generates an impact therein; and (c) an automatic regulator for regulating the damping means outflow through the slot prior to the impact and having a valve biased by a spring means, the slot being narrower as pressure inside the impact chamber increases, thereby pushing the valve out of the impact chamber and the damping means inside the impact chamber fills the vacated space occupied by the valve and decreasing the damping means through the slot; (d) whereby the pressure in the impact chamber remains low as the impact chamber is sealed by the piston end which enters the throat, and thereby the energy lost is insignificant.

Defined even more broadly, the present invention is an apparatus for generating impacts, comprising (a) at least one cylinder having a reciprocating piston therein, an impact chamber relative to the reciprocating piston, a damping means located within the impact chamber, a cavity relative to the impact chamber for receiving and diverting the damping means, and a throat for connecting the impact chamber with the cavity; (b) the reciprocating piston reciprocating within the at least one cylinder, such that when the reciprocating piston approaches and enters the throat and thereby closes the impact chamber from the cavity, the reciprocating piston stops and presses against the damping means inside the impact chamber, and thereby generates an impact therein; and (c) an automatic regulator for regulating the damping means outflow through a slot to the cavity to allow the reciprocating piston to move through the throat and close the impact chamber from the cavity.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for generating impacts, comprising at least one hydraulic cylinder having a reciprocating piston with an inertia mass, an impact chamber relative to the reciprocating piston, a cavity relative to the impact chamber for receiving and diverting fluid, and a throat for connecting the impact chamber with the cavity;

said reciprocating piston having one end with the same diameter as said throat, such that when said reciprocating piston approaches said throat, a slot is formed between said piston end and said throat and disappears when said piston enters said throat and thereby closes said impact chamber from said cavity, said reciprocating piston stops and presses against the fluid inside said impact chamber, and thereby generates an impact therein;

an automatic regulator for regulating the pressure in said chamber prior to the impact and the fluid outflow through said slot to said cavity to allow said reciprocating piston to enter and move through said throat and close said impact chamber from said cavity.

2. The apparatus in accordance with claim 1 wherein said automatic regulator has at least one two position valve relative to said impact chamber, the at least one valve being pushed out from said impact chamber while increasing the capacity of said impact chamber in the process of closing said throat, and when the fluid pressure in said cavity and said impact chamber level out, the at least one valve returns to its starting position.

3. The apparatus in accordance with claim 1 wherein said fluid is oil.

4. The apparatus in accordance with claim 1 further comprising means for regulating the impact force by changing a chamber working capacity.

5. The apparatus in accordance with claim 1 further comprising a reservoir cavity for said fluid.

6. The apparatus in accordance with claim 5 wherein said reservoir cavity and said cavity for receiving and diverting said fluid are located coaxially to each other and connected by a duct located within said reciprocating piston.

7. The apparatus in accordance with claim 1 further comprising spline roller joints for connecting said inertia mass to said at least one cylinder.

8. The apparatus in accordance with claim 1 further comprising at least one driving cylinder for reciprocating said reciprocating piston and having a piston therein.

9. The apparatus in accordance with claim 7 further comprising a developer for working the fluid output, the developer fixed to said at least one hydraulic cylinder and having a motionless plunger slidably inside the piston.

10. The apparatus in accordance with claim 5 wherein said reservoir cavity is located in a separate cylinder.

11. An apparatus for generating impacts, comprising:

at least one hydraulic cylinder including a reciprocating piston having an inertia mass, an impact chamber, a cavity for receiving and diverting fluid, and a throat for connecting the impact chamber with the cavity;

said reciprocating piston having one end with the same diameter as said throat, said piston moves into an upper position so that when said piston drops down and enters said throat, thereby forming a slot between said piston end and said throat and closing said impact chamber from said cavity, said piston stops and presses against the fluid inside said impact chamber, and thereby generates an impact therein;

means for driving said reciprocating piston; and an automatic regulator for regulating the fluid outflow through said slot prior to the impact and having at least one biased valve, said slot being narrower as pressure inside said impact chamber increases, thereby pushing the at least one valve out of said impact chamber and the fluid inside said impact chamber fills the vacated space occupied by the at least one valve and decreasing the fluid outflow through said slot;

whereby the pressure in said impact chamber remains low as said impact chamber is sealed by said piston end which enters said throat, and thereby the energy lost is insignificant.

12. The apparatus in accordance with claim 11 further comprising means for regulating the impact force by changing a chamber working capacity.

13. The apparatus in accordance with claim 11 further comprising spline roller joints for slidably connecting said inertia mass to said at least one cylinder.

14. The apparatus in accordance with claim 11 further comprising at least one driving cylinder for reciprocating said inertia mass.

15. The apparatus in accordance with claim 11 wherein said fluid is oil.

16. An apparatus for generating impacts, comprising at least one hydraulic cylinder having a reciprocating piston with an inertia mass, an impact chamber relative to the reciprocating piston, a cavity relative to the impact chamber for receiving and diverting fluid, and a throat for connecting the impact chamber with the cavity;

said reciprocating piston having one end with the same diameter as said throat, such that when said reciprocating piston approaches said throat, a slot is formed between said piston end and said throat and disappears when said piston enters said throat and thereby closes said impact chamber from said cavity, said reciprocating piston stops and presses against the fluid inside said impact chamber, and thereby generates an impact therein;

an automatic regulator for regulating the pressure in said chamber prior to the impact and the fluid outflow through said slot to said cavity to allow said reciprocating piston to enter and move through said throat and close said impact chamber from said cavity; and driving means for driving said reciprocating piston.

17. The apparatus in accordance with claim 16 wherein said automatic regulator has at least one two position valve relative to said impact chamber, the valve being pushed out from said impact chamber while increasing the capacity of said impact chamber in the process of closing said throat, and when the fluid pressure in said cavity and said impact chamber level out, the at least one valve returns to its starting position.

18. The apparatus in accordance with claim 16 further comprising means for regulating the impact force by changing a chamber working capacity.

* * * * *